US006176317B1

(12) United States Patent
Sepich

(10) Patent No.: US 6,176,317 B1
(45) **Date of Patent: *Jan. 23, 2001**

(54) HYDROCARBON VENT HOOD

(76) Inventor: John Edward Sepich, 680 Walnut St., Moorpark, CA (US) 93021

( * ) Notice: Under 35 U.S.C. 154(b), the term of this patent shall be extended for 0 days.

This patent is subject to a terminal disclaimer.

(21) Appl. No.: 09/324,311

(22) Filed: Jun. 2, 1999

Related U.S. Application Data

(63) Continuation-in-part of application No. 08/938,865, filed on Sep. 26, 1997, now Pat. No. 5,921,321.
(60) Provisional application No. 60/033,064, filed on Dec. 13, 1996.

(51) Int. Cl.[7] ..... E21B 33/02; E21B 33/03
(52) U.S. Cl. ..... 166/379; 166/75.13; 166/79.1; 166/85.1; 52/20
(58) Field of Search ..... 166/75.13, 75.14, 166/79.1, 85.1, 85.5, 379; 52/20; 404/25, 26; 137/363, 371

(56) References Cited

U.S. PATENT DOCUMENTS

| | | | | |
|---|---|---|---|---|
| 695,278 | * | 3/1902 | Cochran | 166/79.1 X |
| 890,573 | * | 6/1908 | Phelan | 52/20 X |
| 1,045,037 | | 11/1912 | Kimball . | |
| 1,395,807 | * | 11/1921 | Forni | 137/371 X |
| 1,642,245 | | 9/1927 | Judy . | |
| 1,830,061 | * | 11/1931 | Howe | 166/79.1 |
| 1,857,788 | | 5/1932 | Murphy . | |
| 2,026,844 | * | 1/1936 | Minahan | 166/79.1 |
| 2,635,696 | | 4/1953 | Asketh . | |
| 3,247,672 | | 4/1966 | Johnson . | |
| 3,380,519 | * | 4/1968 | Fowler | 166/379 |
| 4,747,453 | * | 5/1988 | Howard, Sr. | 166/379 |
| 4,971,149 | * | 11/1990 | Roberts | 166/92.1 |
| 5,010,957 | * | 4/1991 | Kenner | 166/379 |
| 5,299,637 | | 4/1994 | Skonvall | 166/75.1 |
| 5,484,020 | | 1/1996 | Cowan | 166/295 |
| 5,503,227 | | 4/1996 | Saponja et al. | 166/277 |
| 5,701,953 | * | 12/1997 | Stecker et al. | 166/379 X |
| 5,921,321 | * | 7/1999 | Sepich | 166/379 |

FOREIGN PATENT DOCUMENTS 2035426 6/1980 (GB) .

OTHER PUBLICATIONS

California Division of Oil, Gas and Geothermal Resources letter of Dec. 14, 1995.
California Division of Oil, Gas and Geothermal Resources letter of May 7, 1996.
California Division of Oil, Gas and Geothermal Resources Regulations dated May 17, 1995.

* cited by examiner

*Primary Examiner*—George Suchfield
(74) *Attorney, Agent, or Firm*—Ralph D. Chabot

(57) ABSTRACT

An improved vent hood for abandoned oil and gas wells which is made of concrete and reinforced with linear and coiled rebar to withstand substantial overburden. The invention can be fabricated in either a two-section conical or cylindrical embodiment. Either of the two-section embodiments allow the base member to be positioned around the abandoned well casing and thereafter filled with gravel. A concrete lid having an aperture is thereafter placed upon the base section with a gas sealant disposed between the mating surfaces of lid and base sections. A vent pipe is thereafter inserted into the aperture to permit gas collected within the vent hood to flow to surface.

20 Claims, 4 Drawing Sheets

Fig. 6a
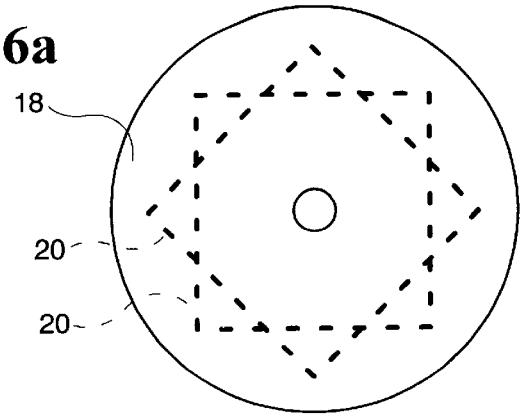
Fig. 6b
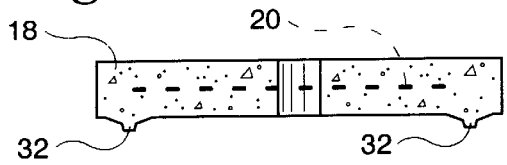
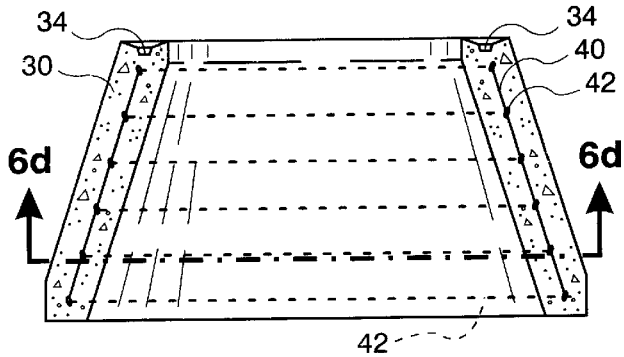
Fig. 6c
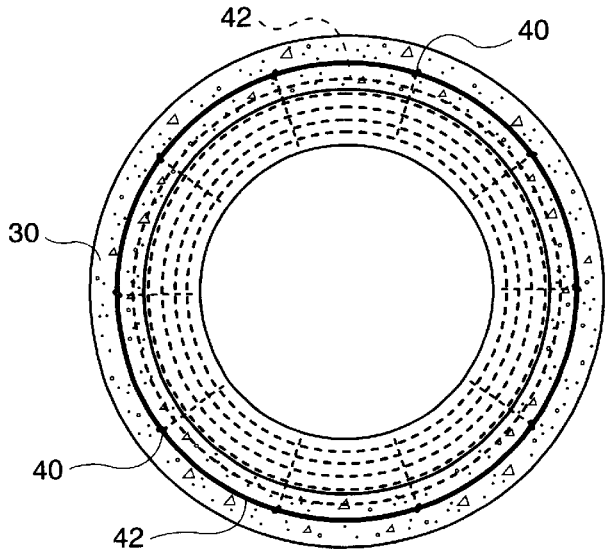
Fig. 6d

HYDROCARBON VENT HOOD

This application is a continuation-in-part of U.S. Ser. No. 08/938,865 filed Sep. 26, 1997, now U.S. Pat. No. 5,921,321, which claims priority under 35 U.S.C. Section 119(e) to a provisional application filed Dec. 13, 1996 bearing Ser. No. 60/033,064.

TECHNICAL FIELD

This invention relates to abandoned natural gas or oil wells and specifically, to the controlled venting of gas and hydrocarbon vapors from the soil adjacent to abandoned wells.

BACKGROUND-DESCRIPTION OF PRIOR ART

Controlled venting of abandoned oil/natural gas wells is sometimes required by regulatory agencies; or may be desired by well owners or property developers. The purpose of controlled venting of an abandoned oil or gas well is to allow gases and hydrocarbon vapors that may come up through or around the abandoned well casing(s) to vent to the atmosphere in a controlled manner.

Casings, as described above, may be either: (1) production casings which are strings of pipe through which gas and/or oil was delivered to the surface from the depth at which it originates in the earth; or, (2) conductor casings which are larger diameter, shorter length casing strings generally used around the production casing to prevent earth caving prior to and during installation of the production casing string.

One agency which has set forth requirements for vent hoods is the State of California (USA), Department of Conservation, Division of Oil and Gas and Geothermal Resources (DOGGR). Their requirements specify minimum dimensions for a vent hood, but do not identify materials of construction. The required minimum dimensions are also intended to provide a volume estimate for the interior or cavity.

Various materials have been used for vent hoods in the prior art. Some of the materials and their method of installation include the following:

A. Brick Cone.

The brick work would begin with a ring of bricks laid to the appropriate diameter on an earth shoulder around an abandoned well. Construction of the brick work would progress with additional courses of brick laid in ever smaller diameters until a cone would be formed around the well. During its construction, the interior of the cone would be filled with rock. A vertical pipe riser would be installed coming out of the top of the cone and run to an above-surface vent riser. Disadvantages of this method include that it is labor intensive; the quality of the field work is variable; and bricks are not considered a perfect methane gas barrier because of the high potential for the gas to escape through joints or cracked masonry units.

B. Fiberglass Cone.

Normal construction would include placing a mound of rock over the abandoned well and then the fiberglass cone on top of the rock mound. Fiberglass is a good gas/vapor barrier. However, there are disadvantages associated with using fiberglass. The shape of the cone may not match the shape of the mound; and cracking of the cone can occur from soil overburden, particularly where the cone is not completely supported by the rock mound. Cracking may also occur at the top of the cone from distress where the vent pipe extends out of the cone, because of the nature of the fiberglass material. Additionally, when a cone is not filled completely with rock, the surrounding soil can eventually migrate underneath the hood into spaces not filled with rock. This migration will then leave soil voids outside the vent cone. These soil voids can eventually lead to undesired settlement observed at the surface. Settlement can cause structural damage, particularly when the abandoned well is in close proximity to buildings or if utility or other conduits are located within the settlement zone.

C. HDPE (High Density PolyEthylene) tank.

A full tank made of heavy HDPE would be cut in half. A half tank would be placed over the well and filled with rock. HDPE is an acceptable gas/vapor barrier. Heavy walled HDPE is somewhat flexible and less likely to crack than fiberglass. Distress can still occur where the vent pipe attaches to the HDPE body. When a cone is not completely full of rock the surrounding soil can eventually migrate underneath the hood into spaces not filled with rock with the same results as described above under fiberglass cones.

D. HDPE plastic sheeting.

HDPE plastic sheeting is very flexible and would not be susceptible to crack failure. The vertical vent pipe would be "booted" to the top portion of the sheeting and would not be susceptible to cracking failure. Disadvantages are that the field HDPE membrane installation involves special equipment for thermal welding, is labor intensive and must be carefully inspected to insure against leaks in seams. The material must also be carefully protected against puncture from the rock fill, and also from the earth backfill. In addition the flexible HDPE membrane does not hold its shape. The normal construction practice has been to carefully line an excavation with the membrane, and then backfill with rock; and finally weld on a lid section of membrane. Here, proper function is dependant upon the accuracy of the excavation. Flexible membrane liners have no structural strength and could tear or puncture. The excavation may also be larger than necessary. If this occurs, more membrane and rock material is required and the cost of installation increases. Also the length of time required to install a flexible membrane can be a disadvantage for a project which requires a fast schedule.

One disadvantage common to all of the prior art described is that all require special on-site inspection during the installation process to observe for cracks and other defects which would affect vent hood integrity.

SUMMARY OF THE INVENTION

My invention, a steel reinforced concrete vent hood, is an improvement over the prior art, for the reasons described below.

The invention provides a stable hood location around an abandoned well. It can be fabricated off-site and transported to the desired location. The vent hood is comprised of a reinforced annular concrete base section, which is either conical or cylindrical in shape, and an annular reinforced concrete lid section.

I define "cavity" to mean the space within the annular base section.

The installation of my invention is as follows:

The base section is first lowered into position so that a portion of the top of the abandoned well's casing is within the cavity of the base.

Gravel is then poured into the base section to fill the cavity. Next, a sealant is applied to the top end of the base section and thereafter, the lid section is lowered upon the base section.

The sealant is therefore between the mating surfaces of the lid and base sections and provides a barrier through which well gas such as methane gas can not escape. Since the lid section is annular in shape, it has an aperture to which a vent pipe can be connected or attached. Gasses migrating up from the abandoned well would enter the porous area of the cavity not occupied by the gravel and, would thereafter be collected through the vent pipe.

The base section can be either conical or cylindrical in shape and either shape utilize a rebar skeleton to provide additional strength to the section. The rebar skeleton comprises coiled rebar disposed circumferentially within the wall of the cone or cylinder, and a plurality of linear rebar evenly spaced and positioned within the wall. Each linear rebar is fastened to the coiled rebar to maintain spacing before the concrete is poured. The fastening means can include, but is not limited to, tie wire or tack-weld. Alternatively, rather than using coiled rebar, a plurality of rebar hoops can be used and fastened to the linear rebar in the same manner as for the coiled rebar mentioned above.

Sizing and placement of both types of rebar may be subject to structural calculations for the specific project loading condition.

For additional protection against gas leakage, a layer or lining which is impermeable to methane gas can be applied to the inward facing wall or inner circumferential surface area of the base section. The layer is capable of spanning cracks in the concrete which are present or which may occur at a later time.

However, given the fact that the wall thickness is substantial and reinforced, it is unlikely that a crack in the concrete will develop through which gas will escape since a vent is provided in the lid section. Stated a different way, gas will travel in a direction offering a path of least resistance. Gas migrating up from around an abandoned well and captured will not escape through a microscopic or hairline crack in a reinforced concrete wall, when it can pass through a vent present in the lid section which is maintained at atmospheric pressure or possibly operated under a slight vacuum.

However, since local building codes may require the additional protection against undesired gas migration, the option is available to provide a layer or lining which is impermeable to methane gas on the inward facing wall of the base section.

Briefly, there are three primary methods for applying the impermeable gas membrane onto the interior wall of either base section. As used in this specification, membrane can mean a spray-on layer, a surface coating, or sheeting material.

The first method is the installation of HDPE (high density polyethylene) sheeting about the interior wall of the base section using a mastic tape with double-sided adhesion. The tape is first attached to the interior circumferential surface near both the top end and bottom end of either base section. Next, the sheeting is disposed on the interior wall circumference of the section, adhering to the mastic tape affixed to the section's interior wall.

The second method utilizes a strip of HDPE or other plastic material which is partially embedded within the base section during its forming and extends out from the base section interior wall into the interior cavity. HDPE sheeting is then lined about the interior cavity and thermal welded to the strip protruding from the concrete surface. HDPE sheeting is typically within the range of 20–100 mils in thickness. Other sheeting which can be used alternatively to HDPE include PVC (polyvinyl chloride) and CPE (chlorinated polyethylene).

The third and most preferred method is to apply the impermeable gas membrane by spray. Besides being faster to apply than HDPE sheeting, the spray-on application allows the membrane material to fill and seal hairline cracks in the concrete which may be present. It is preferred that a chloroprene modified asphalt be used as the spray-on material. Depending upon weather conditions, a catalyst may be added to the spray mix to accelerate the cure time of membrane. Other formulations of spray-on substances may also be used to obtain an impermeable methane gas membrane.

A fourth method of applying an impermeable gas membrane is to use a commercially available composite or laminate material consisting of a plastic sheet, upon which a mastic layer has been factory applied, followed by a peel-off sheet. The peel off sheet is removed to expose the sticky mastic layer. The mastic layer is then applied to the interior circumferential surface area of the base section.

If the interior wall of the base section is to be lined with a gas membrane, it is also recommended that the bottom face of the lid section have an impermeable gas membrane. Any of the three methods described above can be used.

In its standard six-inch thick wall, reinforced concrete configuration, my invention can be buried up to 50 feet deep; and deeper with modifications to the wall thickness and/or reinforcing steel placement as required.

The conical concrete section provides considerable resistance to overburden loads because of the great strength of reinforced concrete in compression. The conical shape is ideal for heavy loading.

The novel vent hood also minimizes stress damage from occurring at the vent pipe connection due to the combination of the reinforced concrete base section and lid, and the various vent pipe connection means described later.

The novel vent hood is comprised of two sections. The two sections comprise a lid and either a cylindrical base or conical base. Either base section has a sufficient opening at the top to allow rock or gravel to be poured through the opening, permitting the interior cavity to be filled. The relative ease to fill the interior cavity is an improvement over one piece devices which are placed over a rock pile, possibly without a close fit to the shape of the pile. Without a close fit, even if the vent hood does not crack due to overburden settlement at the void areas, the surrounding soil can still eventually migrate underneath the hood into spaces not filled with rock. This migration is undesirable for the reasons mentioned earlier.

Quality control can be maintained during fabrication of the vent hood and inspection of the fabricated vent hood can occur prior to installation. Special on-site inspection of the vent hood fabrication is therefore unnecessary. This minimizes field labor and installation time resulting in a lower labor cost over the prior art installations. The installation process is as follows. The base of either configuration (cylinder or conical) is positioned over an abandoned well. Normally the casing has been exposed by excavation and which provides some flat or deck area at the base of the excavation around the well. The excavation may be five to twenty feet deep, or even deeper below the adjacent grade (ground surface elevation). The base section is then lowered into position and thereafter rock can be added to the base interior before a reinforced concrete lid is placed on top of the base section. Specifically, rock can be poured directly into either cylindrical or conical base section from the top opening or orifice.

The second (lid) section is thereafter lowered into position. Although the mating surfaces can be flat, preferably a positioning means is utilized to more easily mate the lid section to the base section.

Several types of positioning means can be utilized.

One configuration is a concave depression on the top end of the base section which, when viewed from the top of the base section, forms a ring in the concrete annulus around the cavity. The lid section has, extending away from its bottom face, a convex lip equal in radial extent as the concave depression. The depth of the depression is greater than the height of the lip so that when the lip is properly positioned above the base section, it can be lowered with the lip fitting within the depression. Since the lip height is not as long as the concave depression, the flat portion of the bottom face of the lid will rest upon the flat portion of the base section.

A second configuration would be a lid section with the circular concave depression and the base section have the circular convex lip.

A third configuration would be a lid section having at least one vertical pin extending away from the bottom face for alignment with a respective vertical depression in the top of the base section.

Numerous other positioning means can be imagined but the purpose is to properly position the lid section upon the base section. Although I have used the term "mating surfaces", it is understood that the proper use of a sealant will result in a layer of sealant between the adjacent lid section and base section surfaces. I therefore define "mating surfaces" to mean either the direct contact of the lid section and the base section; or, a base section/sealant/lid section interface.

A sealing means is utilized to prevent gas leakage and more specifically, methane gas leakage at the mating interface of lid and base sections. The sealing means can include a sealant such as an asphaltic neoprene, or other material with low gas permeability.

To satisfy more demanding local building code requirements, the inward facing surface of both the base and lid sections may have a layer or lining which is impermeable to methane gas as added protection against gas migration through cracks in the concrete which are present or which may occur at a later time.

A low gas permeability material is however, necessary between the lid/base interface as a sealant to prevent gas from escaping between the base and lid interface.

The lid section contains an orifice through which any captured gas migrating from the abandoned well can be directed to another location such as a vent stack or compressor on the surface. Typically, a vent pipe is installed to communicate any gas captured within the hollow conical or cylindrical vent hood, to a vent stack located above the ground. The vent pipe utilizes conventional connection means such as a rubber ring made to join piping, or caulking directly into the lid, or a threaded or slip fitting cast into the lid.

Where a number of vent installations will occur, the invention also has the advantage in that a number of vent hoods can be fabricated and inspected as a group prior to installation.

Although adding rock to the interior is not required, it is recommended. Preferably, specially sized pea rock is used. Pea rock may be approximately ¼ inch in overall dimension. This small size minimizes the chance of damage to the impermeable membrane liner which might be a problem with larger rock. Also the use of pea rock provides good permeability for gas movement while still acting to keep soil migration out of the inner cavity of the base section.

The use of a vent hood without rock added to the interior could be used in jurisdictions where there is no government agency requirement for rock, and where there is no danger of soil migration into the vent hood as described above. Soil migration might not be a problem, for instance, in native rock with specially designed backfill and installation.

In summation, my invention is an improvement over prior art configurations because a structurally reinforced concrete vent hood having an impermeable gas barrier is provided where inspection can occur off-site, and thereafter transported and installed onlocation quickly and efficiently.

DESCRIPTION OF THE DRAWINGS

FIG. 6*a* i s a top view of the lid of FIG. 2*a*.

FIG. 6*b* shows one embodiment of the tongue arrangement illustrated in FIG. 3 in relation to the lid.

FIG. 6*c* illustrates a base section rebar skeleton constructed of linear rebar and rebar hoops.

FIG. 6*d* is a cross-section of the base section of FIG. 6*c* taken along line 6*d*–6*d*.

DETAILED DESCRIPTION OF THE PREFERRED EMBODIMENT

Figure 1:
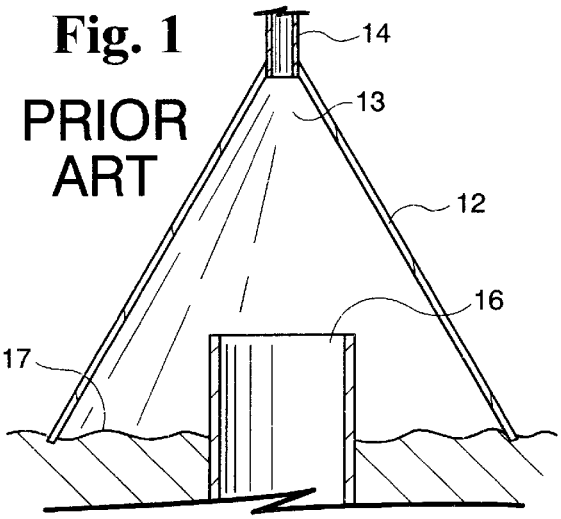
Fig. 1 PRIOR ART
FIG. 1 illustrates a prior art embodiment.

FIG. 1 illustrates a prior art vent hood. A single section cone 12 is provided having a vent pipe 14 extending from the top orifice 13 to above ground level.

An abandoned oil well casing 16 is exposed with the surrounding soil 17 excavated to a desired level below the top of casing 16. Preferably, casing 16 is exposed at least 12 inches. The base diameter of vent hood 10 at its bottom end is required to be larger than the diameter of the hole drilled to install casing 16.

Figure 2A:
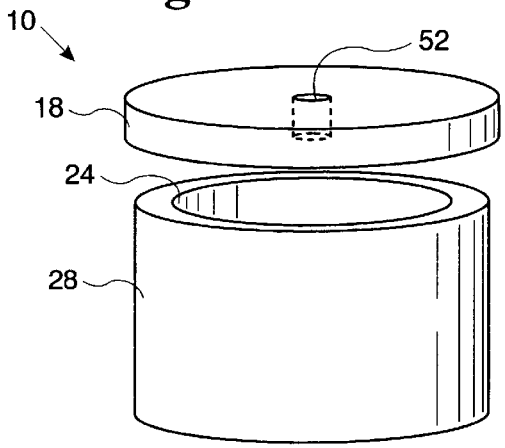
FIG. 2*a* illustrates the invention in a two section cylindrical base and lid configuration.
Figure 2B:
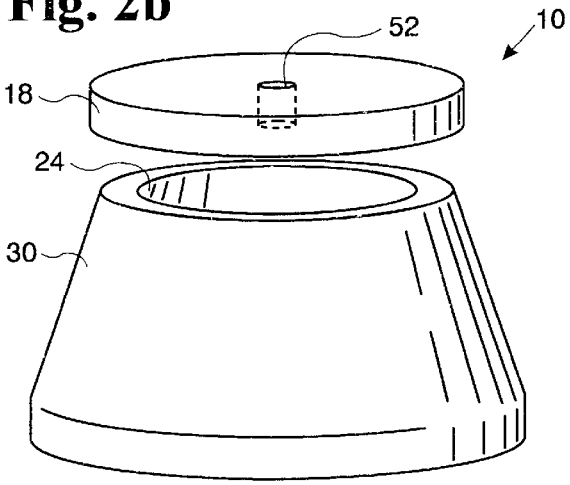
FIG. 2*b* illustrates a two-section conical base and lid embodiment.

FIG. 2*a* (lid 18 and cylindrical base 28) and FIG. 2*b* (lid 18 and conical base 30) are embodiments of my invention.

Both embodiments have a sufficient top opening or orifice 24 to allow gravel, if necessary, to be poured into the base section after it is positioned properly about the casing. A tight gravel pack (not shown) within the cavity of the base section is, in many cases, an governmental agency requirement.

Structural engineering calculations prepared for my vent hood indicate that the strength of the hood is adequate without the need of a gravel pack.

In some types of soils, the gravel pack is helpful to prevent migration of the surrounding soils into the base section cavity, which could plug the venting system or possibly lead to settlement of earth above the vent hood. There are types of soil where this is not a problem; and there are installation techniques such as utilizing geotextiles spanning under the base of the vent hood to keep soils out of the cavity after burial.

Because my vent hoods can withstand substantial overburden due to the rebar reinforced design, a gravel pack is not necessary for the interior cavity except to satisfy a government requirement. The two piece conical configuration of FIG. 2*b* is preferred to the cylindrical design of FIG. 2*a*.

During the vent hood fabrication process, a skeleton or cage of rebar is fabricated. As shown in FIG. s 6*e*, and 6*f*, this cage comprises a plurality of linear rebar 40. It is noted that the steel skeleton may also be fabricated for cylindrical base 28. The linear rebar 40 is preferably spaced 5 inches from one another. Coiled rebar 42, preferably of a thickness of #4 or heavier, is fastened to the linear rebar from the lower to upper end of the base section. As coiled wire 42 contacts a linear rebar 40, each is fastened to the other by an appropriate means such as tie-wire or a tack weld. Preferably, as coiled rebar 42 is fastened to linear rebar 40, the spacing is no greater than 5 inches from the coil above or below. Once the rebar skeleton is fabricated, concrete is poured about the rebar skeleton to form the base section. Linear rebar 40 is preferably evenly spaced within the concrete wall of the base section and about the cavity.

Alternatively as shown in FIG. s 6*c* and 6*d*, concentric hoops of rebar can be used instead of the coiled rebar described in FIG. s 6*c* and 6*d*.

Lid 18 is formed in a similar manner. For structural integrity, a pair of linear rebar 20 are formed into squares. Squares 20 are then positioned above one another and orientated so that one is offset to the other by 45 degrees. Concrete is then poured about linear rebar 20 to form lid 18 which is shown in FIG. s 6*a* and 6*b*.

Figure 3:
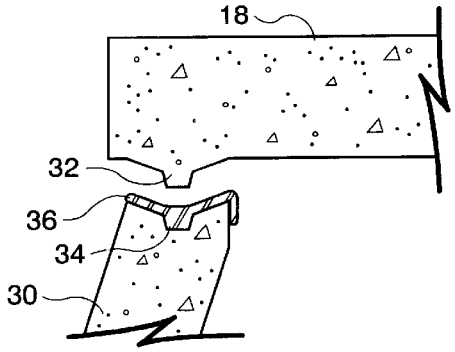
FIG. 3 shows the tongue and groove configuration of the lid and base sections respectively.

Although not required, it is preferred that a tongue 32 and groove 34 arrangement be utilized for properly fitting lid 18 onto base section 28 or 30. As illustrated in FIG. 3, proper installation of lid 18 to the base section would include the application of a sealant 36 about the tongue/groove interface which would also act to prevent methane gas from escaping through the lid/base section interface. The preferred configuration would be to have concave or groove depression on the top end of the base section which, when viewed from the top of the base section, forms a ring in the concrete annulus around the cavity. Lid 18 has, extending away from its bottom face, a convex tongue equal in radial extent as the concave depression.

Once vent hood 10 is in position, vent pipe 14 can be joined to vent hood 10 by a number of conventional means as best illustrated in FIG. s 4*a*, 4*b*, 4*c*, 4*d* and 4*e*.

Figure 4A:
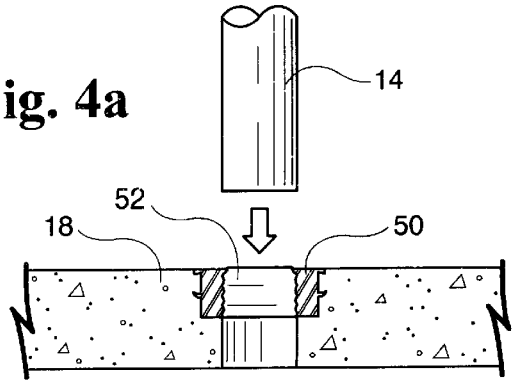
FIG. 4*a* illustrates connection of vent piping using a rubber ring.

FIG. 4*a* illustrates a rubber ring push joint embodiment. Rubber ring 50 is disposed about an aperture 52 in lid 18. Aperture 52 can be made either during the forming of lid 18 or cored after lid 18 is formed.

Figure 4B:
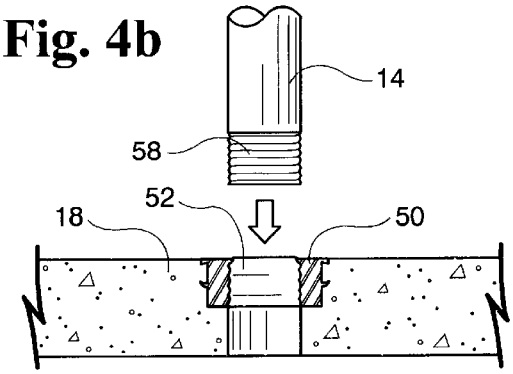
FIG. 4*b* illustrates a first alternative means of attaching a vent pipe to the invention.

FIG. 4*b* illustrates an alternative rubber ring push joint embodiment which utilizes threaded end portion 58 to frictionally engage with rubber ring 50.

Figure 4C:
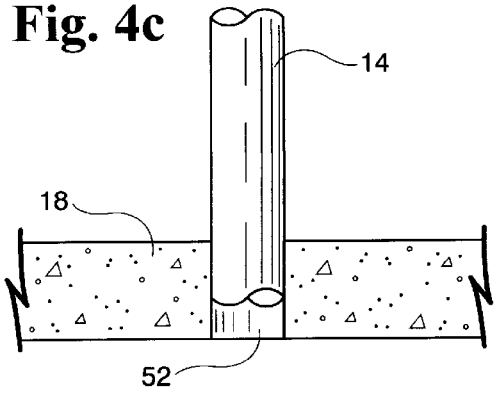
FIG. 4*c* illustrates a second alternative means of attaching a vent pipe to the invention.

FIG. 4*c* illustrates aperture 52 having a diameter slightly larger than the outside diameter of vent pipe 14. Insertion of vent pipe 14 into aperture 52 produces a snug fit interface. The interface is thereafter caulked or other type of sealant is used to secure in place.

Figure 4D:
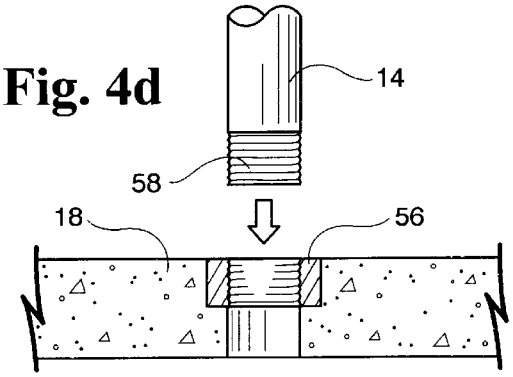
FIG. 4*d* illustrates a third alternative means of attaching a vent pipe to the invention.

FIG. 4*d* illustrates a threaded female fitting 56 cast into aperture 52 of lid 18. Vent pipe 14, in this configuration, has a threaded end portion 58 for threadably engaging female fitting 56.

Figure 4E:
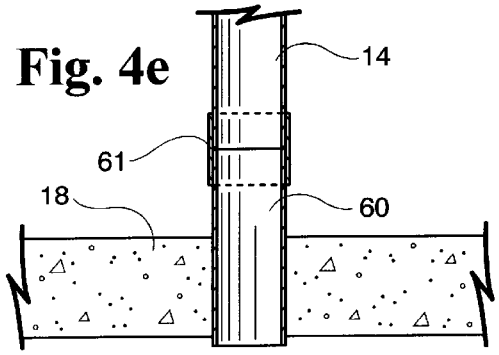
FIG. 4*e* illustrates a fourth alternative means of attaching a vent pipe to the invention.
Figure 5A:
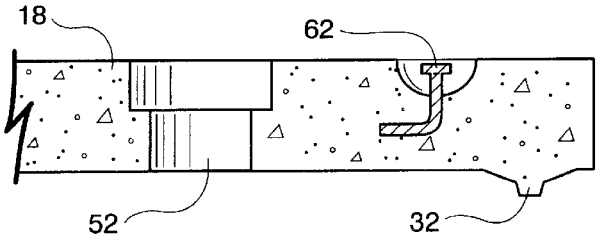
FIG. 5*a* is a partial view of the lid section utilizing a first embodiment lifting pin.
Figure 5B:
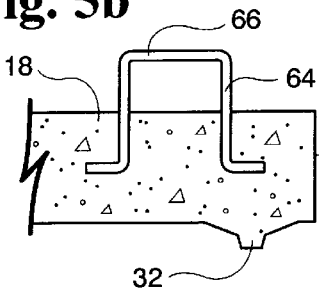
FIG. 5*b* is a partial view of the lid section utilizing a second embodiment lifting pin.
Figure 5C:
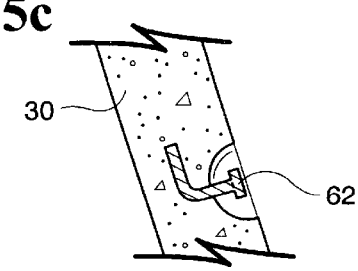
FIG. 5*c* is a partial view of the base section utilizing a first embodiment lifting pin.
Figure 5D:
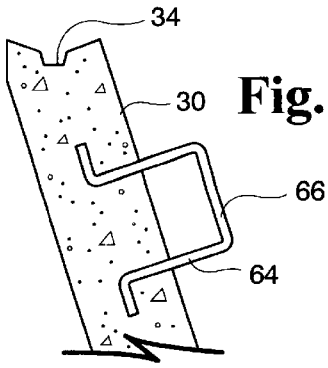
FIG. 5*d* is a partial view of the base section utilizing a second embodiment lifting pin.
Figure 6E:
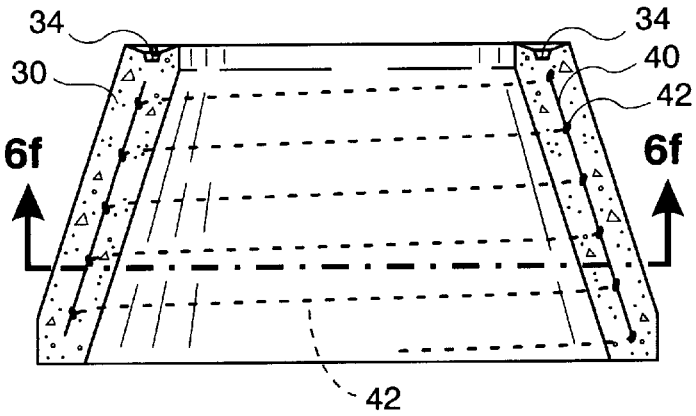
FIG. 6*e* shows second embodiment of a base section rebar skeleton which is constructed of linear and coiled rebar.
Figure 6F:
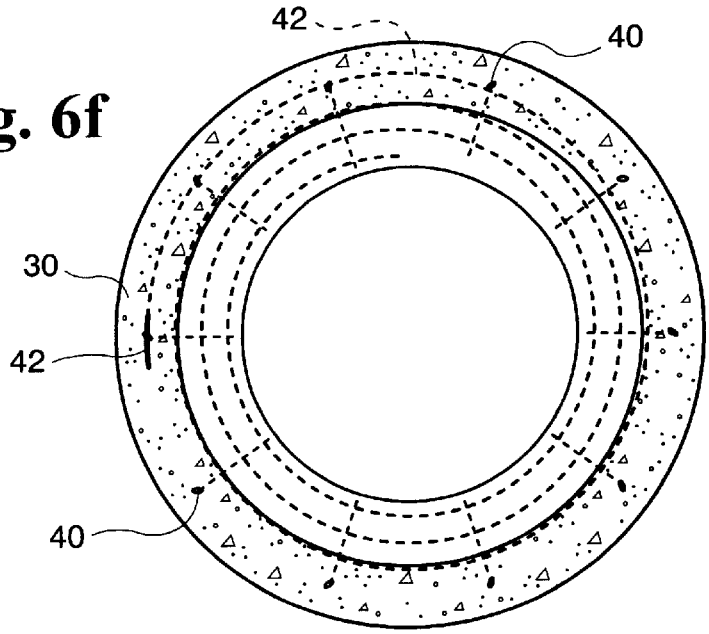
FIG. 6*f* is a cross-section of the base section of FIG. 6*e* taken along line 6*f*–6*f*.

FIG. 4*e* illustrates a pipe spool 60 which is cast into aperture 52 of lid 18. Pipe spool 60 is thereafter attached to vent pipe 14 by coupling 61 in any conventional manner such as slip fitting, thread engagement, etc.

Because of the preferred material of construction, my invention is relatively heavy. To facilitate an efficient means of transport and positioning, my invention incorporates the use of a lifting means. Two embodiments of a lifting means are illustrated in FIG. s 5*a*, 5*b*, 5*c*, and 5*d*. Lifting pin 62 is defined as having one end embedded in the concrete wall and having a stem with a headed end extending away from the exterior wall surface. Lifting eye 64 is defined as having both ends embedded in the concrete wall with a center portion extending away from the exterior wall surface to form a loop 66. Pin 62 or eye 64 is preferably made of a rigid material and most preferably, steel or iron. A cable (not shown) can be temporarily secured to a lifting means on any section of vent hood 10 and lifted to a desired location by a winch or other suitable lifting device.

Other features and advantages of the invention will become apparent to those skilled in the art upon review of the following detailed description and claims.

I claim:

1. A vent hood for abandoned oil or gas wells comprising:

a base section and a lid section;

said base section comprising a concrete, annular body having an exterior wall surface and an interior wall surface, said base section further having a bottom end and a top end, said bottom end having a first orifice and said top end having a second orifice;

a rebar skeleton disposed within said concrete wall to provide increased structural strength; and, said lid section comprising a concrete lid having an annular body having rebar disposed within said concrete lid, said lid having a radial extent substantially equal to the top of said base section, said lid having a top face, a bottom face; and an aperture between said faces.

2. The vent hood of claim 1 further comprising a sealing means impermeable to methane gas which is positioned between said top end of said first section and said bottom face of second section.

3. The vent hood of claim 1 having a means to attach one end of a vent pipe partially within said aperture of said lid section.

4. The vent hood of claim 2 having a means to attach one end of a vent pipe partially within the aperture of said lid section.

5. The vent hood of claim 1 further comprising a layer impermeable to methane gas on said interior wall surface and on said bottom face.

6. The vent hood of claim 5 further comprising a sealing means impermeable to methane gas which is positioned between said top end of said base section and said bottom face of lid section.

7. The vent hood of claim 2 wherein said sealing means comprises a layer of asphaltic neoprene.

8. The vent hood of claim 6 wherein said sealing means comprises a layer of asphaltic neoprene.

9. The vent hood of claim 5 having a means to attach a vent pipe partially within the communicative aperture of said lid section.

10. The vent hood of claim 1 further comprising a lifting means.

11. The vent hood of claim 5 further comprising a lifting means.

12. The vent hood of claim 1 wherein said where said rebar skeleton comprises:

(A) a plurality of linear rebar;

(B) a coiled rebar fastened to said plurality of linear rebar.

13. The vent hood of claim 1 wherein said where said rebar skeleton comprises:

(A) a plurality of linear rebar;

(B) a series of rebar hoops fastened to said plurality of linear rebar.

14. The vent hood of claim 1 wherein said top end of said base section and said bottom face of said lid section utilize a tongue and groove arrangement for properly disposing said lid section upon said base section.

15. An improved method of venting gas from abandoned oil and gas wells, the improved method comprising:

providing a vent hood having a first section and a second section, said first section comprising an annular concrete body having an exterior wall surface and an interior wall surface, said first section further having a base end and a top end, said base end having a first orifice and said top end having a second orifice; a space between said interior wall surface and said base end and said top end defining a cavity; a rebar skeleton disposed within said concrete wall; said second section comprising a concrete lid having an annular body, said lid having steel rebar disposed within and said lid having a radial extent substantially equal to the top of said first section, said lid further having a top face, a bottom face and an aperture extending from the top face to the bottom face;

positioning said first section over the top of the abandoned well;

lowering said first section so that the abandoned well will be partially disposed within said first section cavity;

applying a methane gas impermeable sealant to said top end of said first section;

positioning said lid section over said top end of said first section;

placing said lid section upon said top end of said first section whereby said sealant forms an impermeable barrier at the lid section-first section interface;

providing a vent pipe; and attaching one end of the vent pipe within the aperture of said lid.

16. The method of claim 15 further comprising filling said cavity with gravel by directing said gravel through said second orifice.

17. The method of claim 15 wherein said first section is shaped in a conical configuration.

18. The method of claim 15 wherein said first section is shaped in a cylindrical configuration.

19. A vent hood for positioning above an abandoned oil or gas well for capture of gas migrating up from the abandoned well comprising:

a conical section and a cover;

said conical section comprising an annular concrete body having an exterior wall surface and an interior wall surface, said conical section further having a base end and a top end, said base end having a first orifice and said top end having a second orifice;

a rebar skeleton disposed within said concrete wall;

said cover comprising a concrete annular body having steel rebar disposed within and having a radial extent substantially equal to the top end of said conical section, said cover having a top face, a bottom face, and an aperture from said top face to said bottom face;

positioning means to properly position said cover upon said conical section;

sealing means to prevent gas from escaping between said conical section and said lid section; and means for directing the captured gas to another location.

20. The vent hood of claim 19 where said positioning means comprises a concave depression in the top end of said conical section, and said cover further having a lip extending away from said bottom face, said lip equal in radial extent as said depression, the depth of said depression being greater than the extent of said lip away from said bottom face.

* * * * *